US006302508B1

(12) United States Patent
Asauchi et al.

(10) Patent No.: US 6,302,508 B1
(45) Date of Patent: Oct. 16, 2001

(54) PRINTING APPARATUS, METHOD OF PRINTING, AND RECORDING MEDIUM

(75) Inventors: Noboru Asauchi; Yukimitsu Fujimori; Koichi Otsuki, all of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/496,407

(22) Filed: Feb. 2, 2000

(30) Foreign Application Priority Data

Feb. 5, 1999 (JP) ..... 11-028515

(51) Int. Cl.[7] ..... B41J 2/205
(52) U.S. Cl. ..... 347/15; 347/40; 347/43
(58) Field of Search ..... 347/12, 15, 40, 347/41, 43; 358/502, 1.9

(56) References Cited

U.S. PATENT DOCUMENTS

| | | | | |
|---|---|---|---|---|
| 4,642,653 | * | 2/1987 | Ito et al. | 347/15 |
| 5,032,851 | * | 7/1991 | Yoshimura | 347/43 |
| 5,610,637 | | 3/1997 | Sekjya et al. | 547/10 |
| 5,650,803 | * | 7/1997 | Tamura et al. | 347/15 |
| 5,745,131 | * | 4/1998 | Kneezel et al. | 347/15 |
| 6,189,993 | * | 2/2001 | Mantell | 347/15 |

FOREIGN PATENT DOCUMENTS

| | | |
|---|---|---|
| 0 540 245 | 5/1993 | (EP) . |
| 0 623 473 | 11/1994 | (EP) . |
| 7-205417 | 8/1995 | (JP) . |

OTHER PUBLICATIONS

Patent Abstracts of Japan, vol. 1999, No. 01, Jan. 29, 1999, JP 10–278244, Oct. 20, 1998.

* cited by examiner

*Primary Examiner*—N. Le
*Assistant Examiner*—Lamson D. Nguyen
(74) *Attorney, Agent, or Firm*—Oblon, Spivak, McClelland, Maier & Neustadt, P.C.

(57) ABSTRACT

In a multi-level printer that enables a plurality of dots to be created in each pixel, the technique of the present invention reduces the unevenness of density and the roughness due to localization of dots in each pixel. The principle of the present invention is applicable to, for example, an ink jet printer that enables ink to be ejected successively in each pixel in the course of the main scan. Multiple tones are expressible in each pixel corresponding to the number of dots created therein. A dot formation pattern is set in such a manner that the center of all dots to be created in each pixel is substantially coincident with the center of the pixel. This arrangement effectively interferes with the localization of dots in each pixel and thereby reduces the unevenness of density and the roughness. In the case of bidirectional recording, this arrangement effectively prevents the misalignment of dot forming positions in a forward pass of the main scan with those in a backward pass of the main scan, thus attaining the high quality printing.

10 Claims, 15 Drawing Sheets

Fig. 12

| | | W1 | W2 | W3 | W4 | W5 |
|---|---|---|---|---|---|---|
| 0 | W1=OFF W2=OFF W3=OFF W4=OFF W5=OFF | | | | | |
| 1 | W1=OFF W2=OFF W3=ON W4=OFF W5=OFF | | | ■ | | |
| 2 | W1=OFF W2=ON W3=OFF W4=ON W5=OFF | | ● | ■ | ● | |
| 3 | W1=OFF W2=ON W3=ON W4=ON W5=OFF | | ● | ■ | ● | |
| 4 | W1=ON W2=ON W3=OFF W4=ON W5=ON | ● | ● | ■ | ● | ● |
| 5 | W1=ON W2=ON W3=ON W4=ON W5=ON | ● | ● | ■ | ● | ● |

PRINTING APPARATUS, METHOD OF PRINTING, AND RECORDING MEDIUM

BACKGROUND OF THE INVENTION

1. Field of the Invention

The present invention relates to a printing apparatus that creates dots to print an image on a printing medium. More specifically the invention pertains to a printing apparatus that enables a plurality of dots to be formed in each pixel, so as to ensure three or more levels of density expression with regard to each pixel.

2. Description of the Related Art

A variety of printers have been used widely as the output apparatus of the computer to print images in a multi-color, multi-tone expression. One of such printers is an ink jet printer that forms dots with several color inks ejected from a plurality of nozzles provided on a print head and thereby records an image. The ink jet printer generally allows expression of only two levels, that is, the dot on level and the dot off level, with regard to each pixel. The ink jet printer accordingly prints an image after the halftone processing that expresses the various tones of original image data by a distribution of dots.

Multilevel printers that enable tone expression of three or greater levels have been proposed as the technique of ensuring the rich tone expression. Examples of such multilevel printers include a printer that enables at most N dots (where N is an integer of not less than 2) to be created in each pixel, in order to ensure expression of multiple tones. This prior art multilevel printer enables expression of (N+1) levels including creation of no dots, thereby attaining the high quality printing with smooth tone expression. In this multilevel printer, an increase in maximum number N of dots created in each pixel extends the range of possible tone expression. Compared with the printer that varies the quantity of ink or the density of ink, this multilevel printer readily attains the tone expression in a wider range.

In the prior art multilevel printer, the increase in maximum number N of dots created in each pixel lowers the printing speed. Namely it is required to lower the speed of the main scan in the case where N dots are created consecutively in each pixel. It is alternatively required to increase the number of passes of the main scan in the case where N dots are created in each pixel by plural passes of the main scan. In either case, the printing speed is lowered. In the prior art multilevel printer that enables at most N dots to be created in each pixel, the maximum number N of dots created in each pixel is determined by taking into account the conflicting factors, that is, the improved picture quality with smooth tone expression and the sufficient printing speed.

In the prior art multilevel printer, there has been no discussion on the positions of dots formed in each pixel. It is thus possible to further improve the picture quality by taking into account the dot forming positions. This is true not only in the ink jet-type multilevel printers but in any multilevel printers that enable a plurality of dots to be created in each pixel.

SUMMARY OF THE INVENTION

The object of the present invention is thus to improve the picture quality in a printing apparatus that enables a plurality of dots to be formed in each pixel.

At least part of the above and the other related objects is actualized by a printing apparatus that forms dots in respective pixels with a print head in response to a driving signal, while scanning the print head relative to one axis of a printing medium forward and backward, thereby printing a resulting image on the printing medium. The printing apparatus includes a drive unit that outputs the driving signal to the print head in the course of forward and backward passes of the scan of the print head and enables at most N dots to be created in each pixel in each pass of the scan, where N is an integer of not less than 2, according to a predetermined dot formation pattern, which has been set by taking into account a deviation of the center of gravity of all dots to be created in each pixel from the center of gravity of the pixel.

In the printing apparatus of the present invention, the number of dots to be created in each pixel varies from 0 to N, in order to enable tone expression of (N+1) levels in each pixel. The printing apparatus of the present invention creates the respective dots according to the predetermined dot formation pattern, which has been set by taking into account the deviation of the center of gravity of all the dots to be created in each pixel from the center of gravity of the pixel. This technique desirably improves the picture quality of the resulting printed image.

The following describes the effects of dot forming positions on the picture quality, prior to the details of the technique of the present invention. In the printer that consecutively forms dots in each pixel while scanning the print head in each pass of the main scan, the position of the center of gravity of each dot is shifted in the main scanning direction. When the maximum number of dots created in each pixel is successively increased, the center of gravity of all the dots formed in each pixel is gradually shifted in the main scanning direction according to the maximum number of dots created in each pixel. A large maximum number N of dots created in each pixel causes the center of gravity of dots to be shifted by a large quantity. Like in the case of misalignment of dot forming positions, the shift of the center of gravity of dots by a large quantity causes the unevenness of density between adjoining pixels or the roughness, thereby lowering the picture quality of the resulting printed image.

The printer that consecutively forms dots in each pixel while scanning the print head in each pass of the main scan has just been proposed recently, and there has been no study on the effects of the dot forming positions on the picture quality. The inventors of the present invention have noted the relationship between the dot forming positions and the picture quality, and found that the picture quality is readily improved by taking into account the dot forming positions.

The technique of the present invention sets the dot formation pattern by taking into account the deviation of the position of the center of gravity of dots formed in each pixel from the position of the center of gravity of the pixel. By way of example, the dot formation pattern is set to cause a variation in deviation of the center of gravity of dots formed in each pixel from the center of gravity of the pixel, which is based on a variation in maximum number N of dots created in each pixel, to be within a specific range that does not affect the picture quality. This arrangement of the present invention effectively prevents the unevenness of density and the roughness due to the positional shift of the center of gravity of dots, thereby attaining the high quality printing. The technique of the present invention readily improves the picture quality of the resulting printed image without changing the hardware configuration of the prior art multilevel printer but only with changing the settings of the dot formation pattern.

The term 'center of gravity' in the specification hereof represents the center of gravity in an area occupied by one or a plurality of dots or by a pixel. In the printing apparatus having a print head that enables formation of variable area dots, the center of gravity of the respective dots may not be positioned symmetrically in the main scanning direction in each pixel. The expression 'at most N dots to be created in each pixel in each pass of the scan' means that at most N dots can be created in each pixel by a single pass of the main scan. The at most N dots may be formed in each pixel by either one of the forward pass and the backward pass of the scan of the print head. Alternatively the at most N dots may be formed in each pixel respectively by the forward pass and the backward pass of the scan.

In the printing apparatus of the present invention, any geometrically defined 'center' may replace the 'center of gravity'. One example of the geometrically defined center is at a specific position that is defined by half the maximum diameter of a dot in the main scanning direction and by half the maximum diameter of the dot in the sub-scanning direction. The geometrically defined center may, however, not be necessarily defined by half the maximum diameters of the dot, but may have some deviation determined by taking into account the visual effects of the human eyes.

A variety of settings are applicable to the dot formation pattern by taking into account the deviation of the center of gravity of the dots formed in each pixel from the center of gravity of the pixel.

In one preferable example, the predetermined dot formation pattern minimizes the deviation of the center of gravity of all the dots to be created in each pixel from the center of gravity of the pixel.

This arrangement enables formation of dots according to the dot formation pattern that minimizes the deviation of the center of gravity of all the dots formed in each pixel from the center of gravity of the pixel. Namely this arrangement ensures dot formation in such a manner that the center of gravity of all the dots formed in each pixel is located in the vicinity of the center of gravity of the pixel, irrespective of the number of dots created in the pixel. This minimizes the shift of the center of gravity of dots formed in each pixel and thereby improves the picture quality of the resulting printed image.

The dot formation pattern of the present invention is, however, not restricted to the pattern that minimizes the deviation of the center of gravity of dots formed in a pixel from the center of gravity of the pixel. Any dot formation pattern other than the pattern that minimizes the deviation may be selected, as long as the dot formation pattern does not significantly lower the picture quality. For example, the dot formation pattern that minimizes the deviation of the center of gravity of dots formed in a pixel from the center of gravity of the pixel may cause a large interval between two dots formed in the pixel. For the better picture quality, however, it is desirable to form two dots closer to each other, which gives a better shape to the resulting large dot. In this case, the dot formation pattern other than the pattern that minimizes the deviation may be adopted by taking into account both the effects of the deviation of the center of gravity of dots formed in a pixel from the center of gravity of the pixel on the picture quality and the effects of the shape of the resulting large dot on the picture quality.

The dot formation pattern may be set by a variety of arrangements. One arrangement independently sets the timings of outputting the driving signal with regard to each number of dots to be created in each pixel. Another arrangement causes dot formation patterns, which correspond to the respective numbers of dots to be created in each pixel, to be related to one another.

In the printing apparatus that adopts the latter arrangement, it is preferable that the drive unit forms dots according to the predetermined dot formation pattern, which has been set by selecting a certain frequency of timings corresponding to a number of dots to be created in each pixel among a frequency of timings M provided with regard to each pixel, where M is an integer of not less than N.

This arrangement enables the driving signal to be output to the drive unit at the timings of a fixed interval. This simplifies the structure of the printing apparatus. In a concrete example, the drive unit of the printing apparatus includes a circuit that outputs driving signal at fixed cycles, and a masking circuit that masks part of the driving signal not to be output to the print head according to the dot formation pattern.

In the printing apparatus of the above application, it is not necessary to make the frequency of timings M provided with regard to each pixel identical with the maximum number N of dots created in each pixel. One possible arrangement selects a certain number of timings among the frequency of timings M, which is greater than N, and causes at most N dots to be created in each pixel. This arrangement enhances the flexibility of the settings of the dot formation pattern and further improves the picture quality of the resulting printed image.

In the printing apparatus that sets the predetermined dot formation pattern by selecting the certain frequency of timings, the driving signal is used to create a fixed size dot. The integer M is an odd number of not less than 3. The predetermined dot formation pattern causes dots to be formed at symmetrical positions in each pixel along the axis of the forward and backward passes of the scan.

The printing apparatus of this application forms a fixed size dot. Formation of dots according to the above dot formation pattern thus makes the center of gravity of all the dots formed in each pixel substantially coincident with the center of gravity of the pixel.

In the case where both M and N are even numbers, the dot formation pattern causes an even number of dots to be formed at symmetrical positions in each pixel along the axis of the forward and the backward passes of the scan. In the case of forming an odd number of dots, it is impossible to make the center of gravity of the dots formed in a pixel completely coincident with the center of gravity of the pixel. The dot formation pattern may, however, be set to enable a dot to be formed at the position adjoining to the axis of symmetry.

In accordance with one preferable application of the printing apparatus of the present invention, the drive unit creates dots in two directions, that is, in both the forward pass and the backward pass of the scan of the print head relative to the printing medium.

In the printing apparatus that creates a plurality of dots in each pixel, especially in the case of bi-directional recording of dots, the positional shift of the center of gravity of dots remarkably lowers the picture quality. In one example shown in FIG. 9A and FIG. 9B, dots are formed in each pixel with driving waveforms W1, W2, and W3. The settings of the dot forming pattern allow formation of one dot in response to the on condition of the driving waveform W1 and formation of two dots in response to the on conditions of the driving waveforms W1 and W2. Each closed square represents the position of the center of gravity of all the dots created in each pixel. This position is significantly deviated from the center of gravity of the pixel. FIG. 9A shows dots formed in the forward pass of the main scan, whereas FIG.

9B shows dots formed in the backward pass of the main scan. FIG. 10 shows dots created according to such settings of the dot formation pattern in the case of bi-directional recording. Raster lines R1 and R3 are formed in the forward pass of the main scan, whereas a raster line R2 is formed in the backward pass of the main scan. When the position of the center of gravity of dots formed in each pixel is deviated from the position of the center of gravity of the pixel, the bi-directional recording causes a misalignment of dot forming positions in the main scanning direction, which results in the poor picture quality.

The printing apparatus of the present invention forms dots to minimize the deviation of the position of the center of gravity of all the dots formed in each pixel from the position of the center of gravity of the pixel. This arrangement effectively minimizes the positional misalignment in the case of bi-directional recording of dots. The technique of the present invention is thus especially effective in the printing apparatus that prints an image by the bi-directional recording method.

In the printing apparatus of the present invention, the driving signal is not restricted to the signal that forms a fixed size dot, but may be a signal that forms at least two variable size dots.

In the printing apparatus of this application, the drive unit creates dots according to the predetermined dot formation pattern, which has been set by selecting a certain frequency of timings corresponding to a number of dots to be created in each pixel among a frequency of timings M provided with regard to each pixel, where M is an integer of not less than N. The driving signal is used to create at least two variable size dots. In this application, it is preferable that the predetermined dot formation pattern causes a minimum size dot to be formed closer to the center of gravity of each pixel.

In the printing apparatus with the driving signal that enables formation of variable size dots, the smaller area dot causes its positional shift of the center of gravity in the main scanning direction to be observed more readily. Namely the position of forming the smaller dot more greatly affects the picture quality. The printing apparatus of the above application enables the smallest size dot to be formed closer to the center of gravity of the pixel. This arrangement effectively reduces the positional shift of the center of gravity and improves the picture quality. Especially this arrangement improves the picture quality of a low tone area, in which the smallest size dot is generally used for printing. Although not necessary, it is preferable that the smallest size dot is formed at the position that is coincident with the center of gravity of the pixel. The deviation of the center of gravity of the small dot from the center of gravity of the pixel should be within a certain range that has the restricted effects on the picture quality. The positional shift of the center of gravity of the dot significantly affects the picture quality in the case of bi-directional recording. It is accordingly preferable that the drive unit of the printing apparatus carries out the bi-directional recording.

In the printing apparatus that uses the driving signal to form the at least two variable size dots, it is further preferable that the drive unit creates dots in two directions, that is, in both the forward pass and the backward pass of the scan of the print head relative to the printing medium. The driving signal enables each variable size dot to be formed in a symmetrical manner with respect to the center of gravity of each pixel. The predetermined dot formation pattern creates dots in such a manner that each variable size dot to be created in each pixel has the center of gravity that is located on a certain side, which has been preset for each variable size dot, relative to the center of gravity of the pixel, whether the variable size dot is created in the course of the forward pass of the scan or in the course of the backward pass of the scan.

The printing apparatus of this application uses the driving signal that enables each variable size dot to be formed in a symmetrical manner with respect to the center of gravity of each pixel. Only one pulse of the driving signal is provided to form one variable size dot at the position that is substantially coincident with the center of gravity of the pixel. Two identical pulses of the driving signal output at different timings are, on the other hand, provided for another variable size dot. In the latter case, a selected one of these two identical pulses is actually output to form a dot at the position that is apart from the center of gravity of the pixel.

One example of this driving signal is shown in FIG. 16A and FIG. 16B. In the example of FIG. 16A and FIG. 16B, dots are created in each pixel with driving waveforms W1, W2, and W3. There are two different types of driving waveforms to form two variable size dots having different quantities of ink, that is, a small dot and a large dot. The driving waveform W2 is used to form the small dot, whereas the driving waveforms W1 and W3 are used to form the large dot. One small dot is created at the position that is substantially coincident with the center of gravity of a pixel in response to the driving waveform W2. Two large dots are created, on the other hand, at symmetrical positions with respect to the center of gravity of a pixel in response to the driving waveforms W1 and W3. A predetermined density is expressed by a combination of one large dot with one small dot. In this case, as shown in FIG. 16A, the driving waveforms W2 and W3 are set on to form one large dot and one small dot. The center of gravity of the two dots created in a pixel is deviated from the center of gravity of the pixel.

In the case of bi-directional recording, the sequence of the driving waveforms output in the forward pass of the scan is reverse to the sequence of the driving waveforms output in the backward pass of the scan. FIG. 9B shows the driving waveforms output in the backward pass of the scan. In the backward pass of the scan, the driving waveforms W1, W2, and W3 are output in this sequence from the right side of the pixel. In the example of FIG. 16, the driving waveforms W1 and W3 are identical with each other. In the backward pass of the scan, the driving waveforms W1 and W2 are accordingly set on to form one large dot and one small dot, which have the center of gravity at the same position as that of the small dot and the large dot formed in the forward pass of the scan, as shown in FIG. 16B.

As described above, the printing apparatus of the above application uses the driving signal that enables each variable size dot to be created in a symmetrical manner in each pixel. Even when the selected dot formation pattern makes the center of gravity of dots formed in one pixel deviated from the center of gravity of the pixel, this arrangement enables the position of the center of gravity of dots formed in the forward pass of the scan to be substantially coincident with the position of the center of gravity of dots formed in the backward pass of the scan. Namely this arrangement makes the center of gravity of dots formed in the forward pass of the scan substantially coincident with the center of gravity of dots formed in the backward pass of the scan in the bi-directional recording, thereby improving the picture quality of the resulting printed image. The above example regards the case of creating two variable size dots having different quantities of ink. The same effects can, however, be attained in the case of creating a greater number of variable size dots.

The principle of the present invention is applicable to any printing apparatuses that create dots by a variety of techniques, for example, a printing apparatus with a print head that creates dots by ejecting ink.

The present invention is also directed to a method of forming dots in respective pixels with a print head in response to a driving signal while scanning the print head relative to one axis of a printing medium forward and backward, thereby printing a resulting image on the printing medium. The method includes the step of outputting the driving signal to the print head in the course of forward and backward passes of the scan of the print head and enabling at most N dots to be created in each pixel in each pass of the scan, where N is an integer of not less than 2, according to a predetermined dot formation pattern, which has been set by taking into account a deviation of the center of gravity of all dots to be created in each pixel from the center of gravity of the pixel.

The present invention is further directed to a recording medium, in which a specific program for driving a printing apparatus is recorded in a computer readable manner, wherein the printing apparatus enables at most N dots to be created in each pixel with a print head in response to a driving signal, where N is an integer of not less than 2, according to a predetermined dot formation pattern, while scanning the print head relative to one axis of a printing medium forward and backward. The specific program includes timing data that specify the predetermined dot formation pattern, which has been set by taking into account a deviation of the center of gravity of all dots to be created in each pixel from the center of gravity of the pixel.

The computer executes the program that is recorded on the recording medium, thereby attaining the printing apparatus and the printing method of the present invention. In one possible application, the main part of the program for driving the printing apparatus is recorded in a separate recording medium, and only the predetermined dot formation pattern may be recorded on the recording medium of the present invention.

Typical examples of the recording medium include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media. Still another application of the invention is a program supply apparatus that supplies the program and the predetermined dot formation pattern to the computer via a communication path.

These and other objects, features, aspects, and advantages of the present invention will become more apparent from the following detailed description of the preferred embodiment with the accompanying drawings.

BRIEF DESCRIPTION OF THE DRAWINGS

FIG. 12 shows dot formation patterns as a second modified example;

DESCRIPTION OF THE PREFERRED EMBODIMENTS (1) Structure of Apparatus

Figure 1:
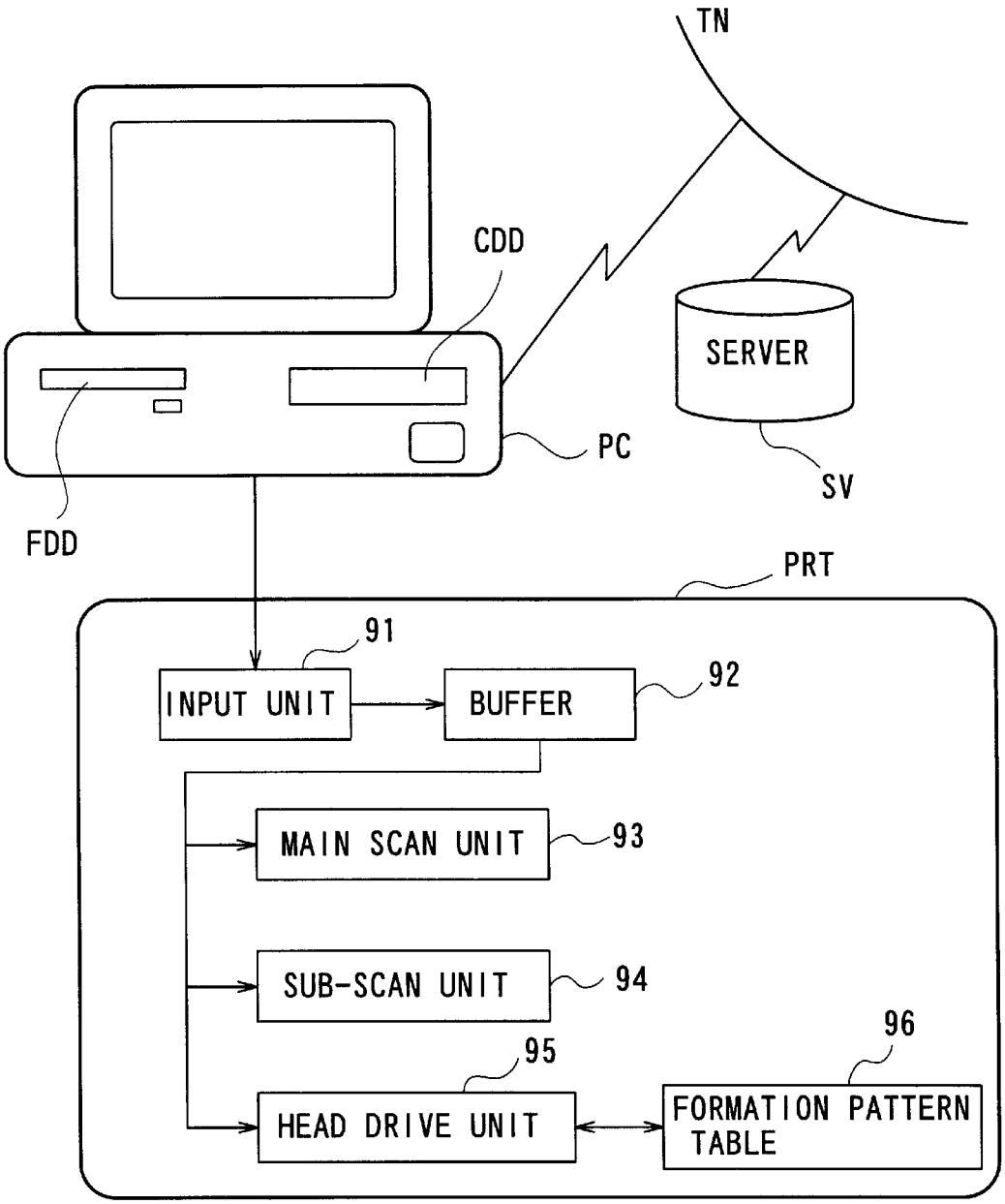
FIG. 1 schematically illustrates the structure of a printing system including a printer PRT in one embodiment according to the present invention.

FIG. 1 schematically illustrates the structure of a printing system including a printer PRT in one embodiment according to the present invention. The printer PRT, which is connected to a computer PC, receives image data output from the computer PC and implements printing based on the input image data. The computer PC is linked with an external network TN, and may gain access to a specific server SV to download programs required for driving the printer PRT. The required programs may otherwise be loaded from a recording medium, for example, a flexible disk set in a flexible disk drive FDD or a CD-ROM set in a CD-ROM drive CDD. Part of the programs thus loaded may be transferred to the printer PRT.

The structure of the printer PRT is shown in FIG. 1 in the form of the functional block diagram. The printer PRT includes an input unit 91, a buffer 92, a main scan unit 93, a sub-scan unit 94, a head drive unit 95, and a formation pattern table 96. The input unit 91 receives image data from the computer PC and temporarily stores the input image data into the buffer 92. The image data output from the computer PC specify a density to be expressed in each of pixels arranged in a two-dimensional array by creating dots in the pixel. The main scan unit 93 carries out main scan that moves a print head in the printer PRT forward and backward relative to a sheet of printing paper, based on the input image data. The sub-scan unit 94 carries out sub-scan that feeds the printing paper in a direction perpendicular to the direction of the main scan after completion of each pass of the main scan. The head drive unit 95 drives the print head in the printer PRT based on the image data stored in the buffer 92, and forms dots on the printing paper in the course of the main scan. As discussed later, the printer PRT of the embodiment enables at most three dots to be formed in each pixel, thus ensuring four levels of density expression. The relationship between the density given in the form of the image data and the dot formation pattern is stored in the formation pattern table 96. The head drive unit 95 refers to the formation pattern table 96 and actually forms dots in each pixel according to the appropriate formation pattern.

Figure 2:
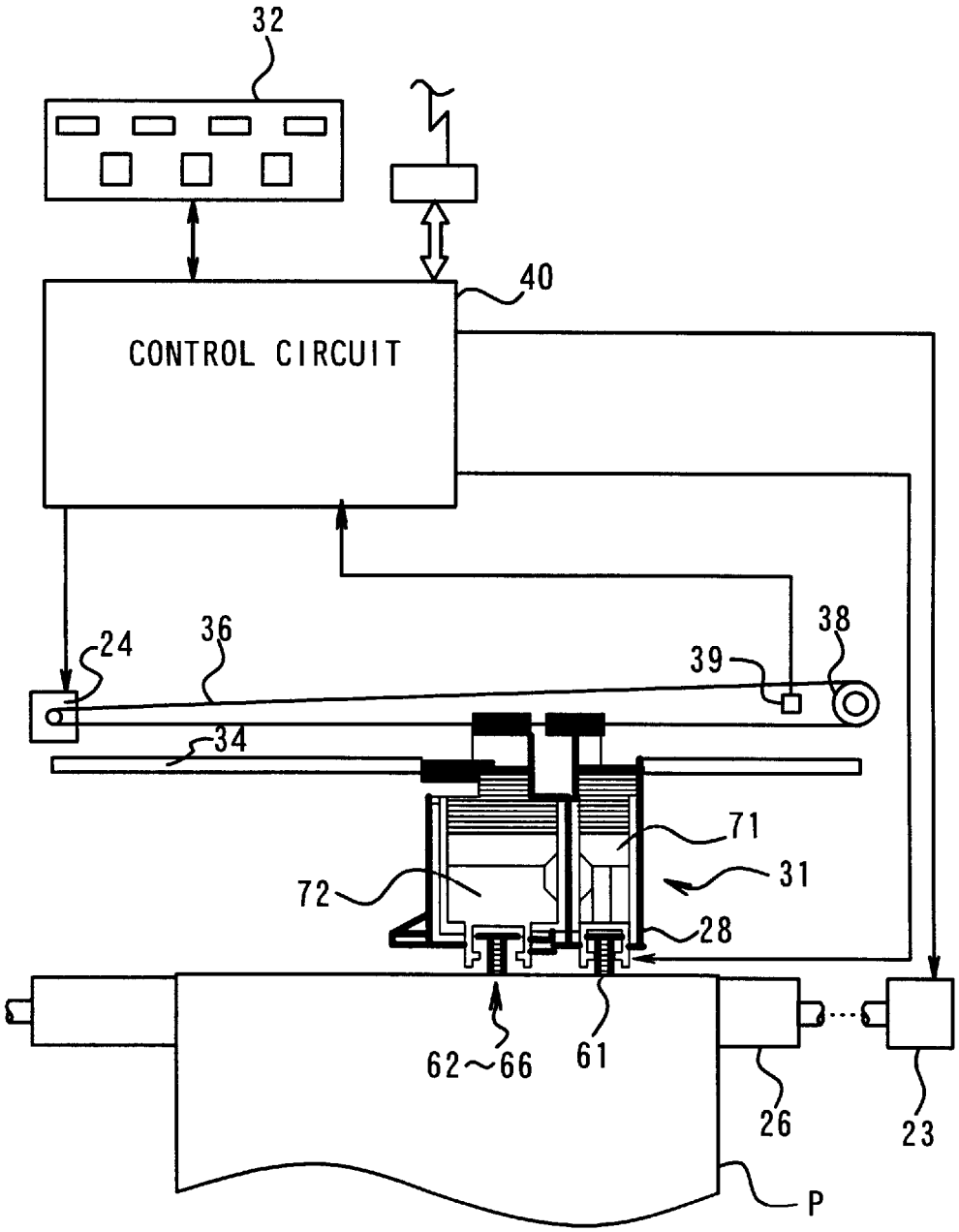
FIG. 2 schematically illustrates the structure of the printer PRT.

The schematic structure of the printer PRT in this embodiment is described with the drawing of FIG. 2. The printer PRT has a mechanism of feeding a sheet of printing paper P by means of a sheet feed motor 23, a mechanism of moving a carriage 31 forward and backward along an axis of a platen 26 by means of a carriage motor 24, a mechanism of driving a print head 28 mounted on the carriage 31 to eject ink and create dots, and a control circuit 40 that controls transmission of signals to and from the sheet feed motor 23, the carriage motor 24, the print head 28, and a control panel 32.

The mechanism of reciprocating the carriage 31 along the axis of the platen 26 includes a sliding shaft 34 that is disposed in parallel with the axis of the platen 26 for slidably supporting the carriage 31, a pulley 38, an endless drive belt 36 that is spanned between the carriage motor 24 and the pulley 38, and a position sensor 39 that detects the position of the origin of the carriage 31.

A black ink cartridge 71 for black ink (Bk) and a color ink cartridge 72 in which five color inks, that is, cyan (C), light cyan (LC), magenta (M), light magenta (LM), and yellow (Y), are accommodated are detachably attached to the carriage 31 in the printer PRT. A total of six ink ejection heads 61 through 66 are formed on the print head 28 that is disposed in the lower portion of the carriage 31. When the black ink cartridge 71 and the color ink cartridge 72 are attached to the carriage 31, supplies of inks are fed from the respective ink cartridges 71 and 72 to the ink ejection heads 61 through 66.

Figure 3:
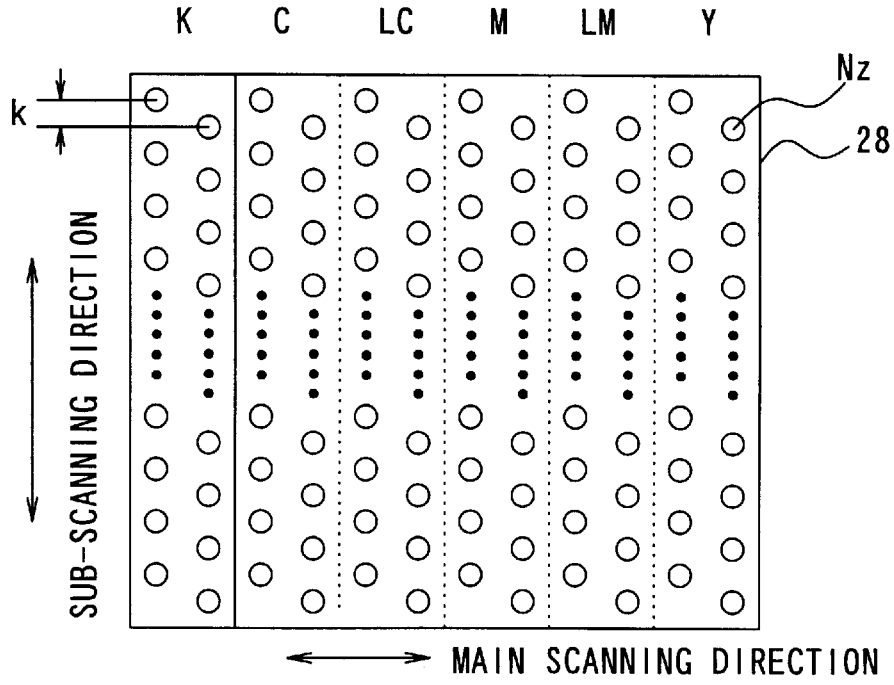
FIG. 3 shows an arrangement of nozzles in the printer PRT.

FIG. 3 shows an arrangement of nozzles Nz in each of the ink ejection heads 61 through 66. The arrangement of nozzles shown in FIG. 3 includes six nozzle arrays, wherein each nozzle array ejects ink of each color and includes forty-eight nozzles Nz arranged in zigzag at a fixed nozzle pitch k. The positions of the nozzles in the sub-scanning direction are identical in the respective nozzle arrays.

Figure 4:
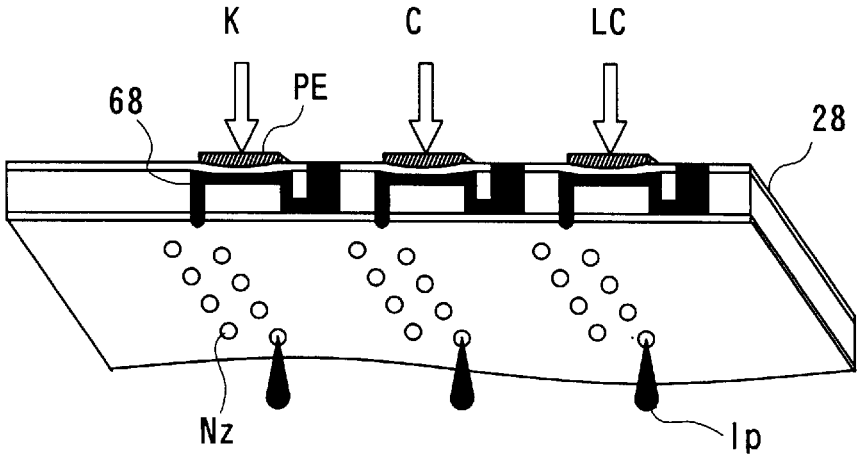
FIG. 4 shows the principle of dot creation in the printer PRT.

The following describes the mechanism of ejecting ink to create dots. FIG. 4 schematically illustrates the internal structure of the print head 28. For the purpose of clarity, the elements with regard to only the black (K), cyan (C), and light cyan (LC) inks are illustrated in FIG. 4. In each of the ink ejection heads 61 through 66, each nozzle Nz has a corresponding piezoelectric element PE that is arranged to be in contact with an ink conduit 68, through which the supply of ink is led to the nozzle Nz as shown in FIG. 4. As is known by those skilled in the art, the piezoelectric element PE deforms its crystal structure by application of a voltage and implements an extremely high-speed conversion of electrical energy into mechanical energy. In this embodiment, when a preset voltage is applied between electrodes on either end of the piezoelectric element PE for a predetermined time period, the piezoelectric element PE is expanded for the predetermined time period to deform one side wall of the ink conduit 68 as shown by the arrows in FIG. 4. The volume of the ink conduit 68 is reduced according to the expansion of the piezoelectric element PE. A certain amount of ink corresponding to the reduction is ejected as an ink particle Ip from the nozzle Nz at a high speed. The ink particles Ip soak into the printing paper P set on the platen 26, so as to implement printing.

Figure 5:
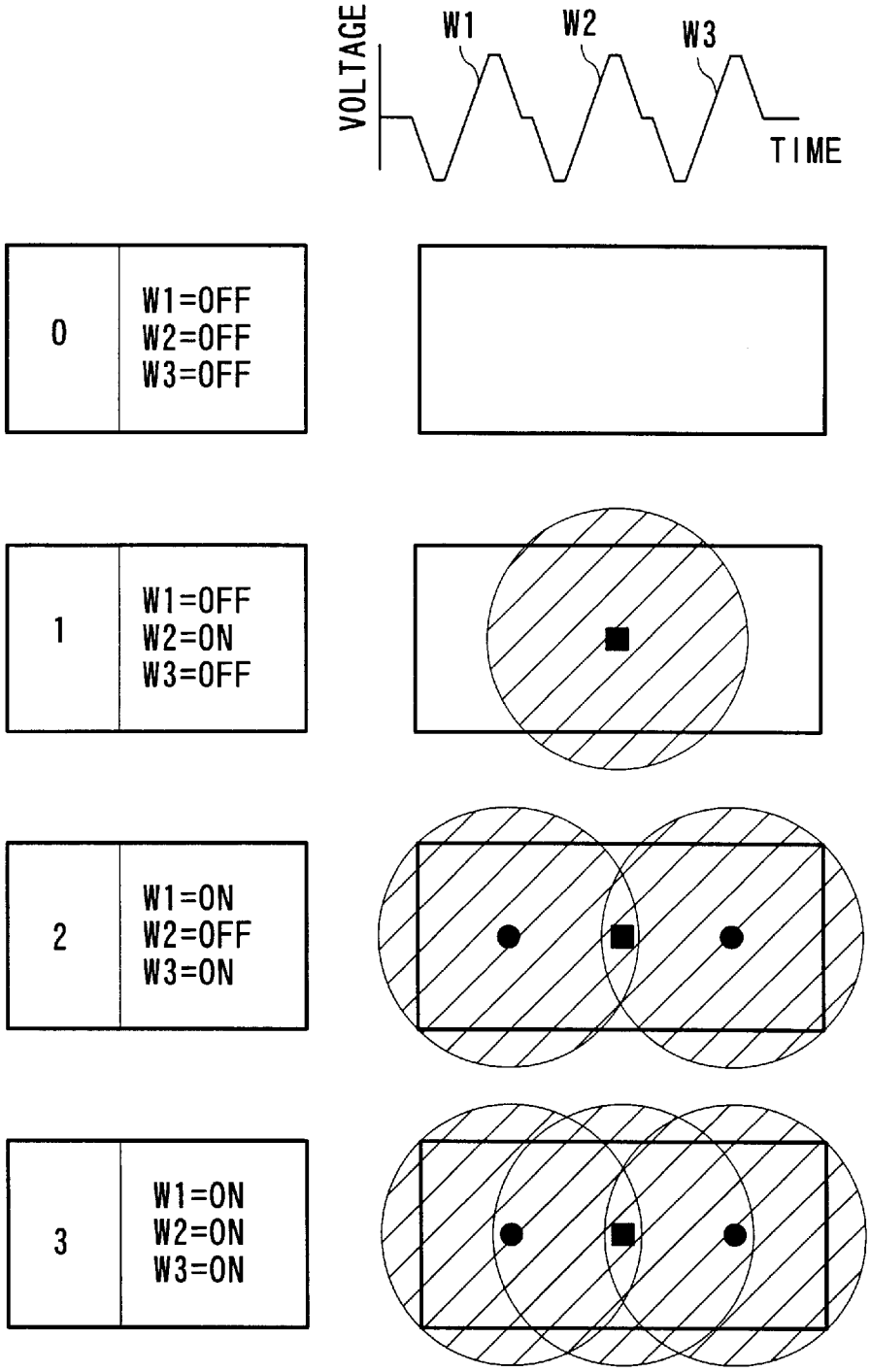
FIG. 5 shows dot formation patterns applied in the embodiment.

The printer PRT of the embodiment expresses four levels of density in each pixel by varying the number of dots formed in each pixel in the range of 0 to 3. FIG. 5 shows dot formation patterns adopted in this embodiment. The printer PRT of this embodiment uses three driving waveforms W1, W2, and W3 to create a dot in each pixel. Each driving waveform first falls from a reference voltage to a lower level, then rises to a higher level than the reference voltage, and finally returns to the reference voltage as shown in FIG. 5. The driving waveforms W1, W2, and W3 are identical. In the printer PRT of this embodiment, the period allocated to each pixel enables output of the three driving waveforms, with the movement of the carriage 31.

The control circuit 40 of the printer PRT selectively sets the on-off conditions of the driving waveforms W1, W2, and W3 according to the size of the dot to be created in each pixel. For example, in the case where the tone value of the image data is equal to 0, which represents creation of no dots, all the driving waveforms W1, W2, and W3 are set off. In this case, no dot is created as shown in FIG. 5.

In the case where the tone value of the image data is equal to 1, which represents creation of a minimum area dot (hereinafter referred to as the small dot), only the driving waveform W2 is set on. In this case, the small dot is formed by one ink droplet ejected from the nozzle as shown in FIG. 5. Each hatched circle represents a dot created in the pixel. Selection of any one of the three driving waveforms W1, W2, and W3 enables the small dot to be created. In this embodiment, the driving waveform W2 is selected to form the small dot on the center of gravity of the pixel. A closed square represents the center of gravity of the dot thus created. Formation of the dot in response to the selected driving waveform W2 enables the center of gravity of the dot created in a pixel to be substantially coincident with the center of gravity of the pixel as shown in FIG. 5.

In the case where the tone value of the image data is equal to 2, which represents creation of an intermediate area dot (hereinafter referred to as the medium dot), the driving waveforms W1 and W3 are set on. In this case, the medium dot is formed by two ink droplets successively ejected from the nozzle as shown in FIG. 5. A closed circle represents the center of gravity of each dot created and a closed square represents the center of gravity of all dots created. Selection of any two of the three driving waveforms W1, W2, and W3 enables the medium dot to be created. In this embodiment, the driving waveforms W1 and W3 are selected, so that the center of gravity of all the dots created in a pixel is made substantially coincident with the center of gravity of the pixel as shown in FIG. 5.

In the case where the tone value of the image data is equal to 3, which represents creation of a maximum area dot (hereinafter referred to as the large dot), all the driving waveforms W1, W2, and W3 are set on. In this case, the large dot is formed by three ink droplets successively ejected from the nozzle as shown in FIG. 5. In the printer PRT of the embodiment, the resolution, that is, the size of the pixel, is set to allow the large dot to sufficiently cover the pixel. In the case of the large dot, the center of gravity of all the dots created in a pixel is made substantially coincident with the center of gravity of the pixel as shown in FIG. 5.

Figure 6:
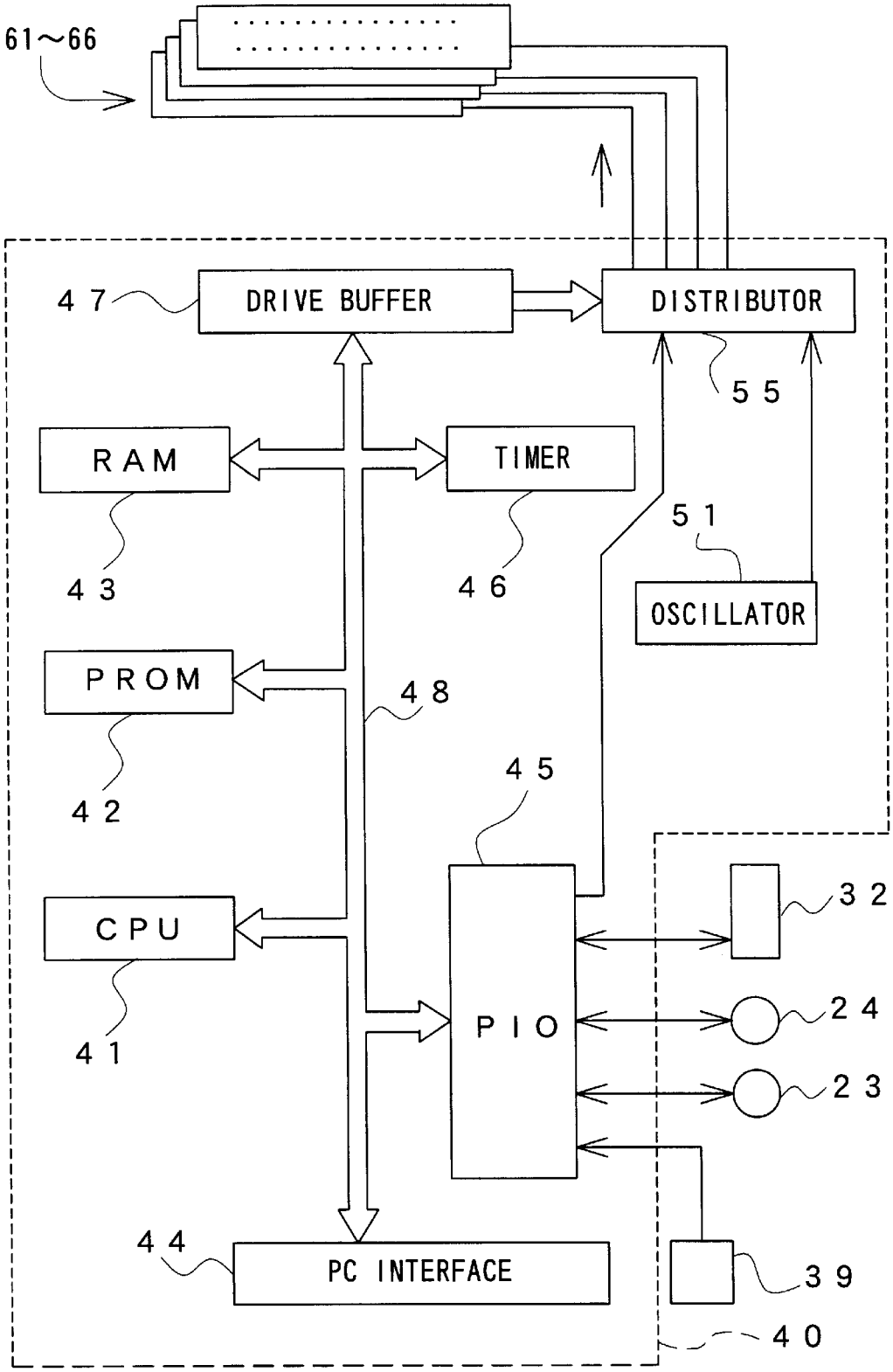
FIG. 6 is a block diagram schematically illustrating the internal structure of a control circuit included in the printer PRT.

The following describes the internal structure of the control circuit 40 in the printer PRT. FIG. 6 illustrates the internal structure of the control circuit 40. The control circuit 40 includes a CPU 41, a PROM 42, a RAM 43, a PC interface 44 that transmits data to and from the computer PC, a peripheral equipment input-output unit (PIO) 45 that transmits signals to and from the peripheral equipment including the sheet feed motor 23, the carriage motor 24, and the control panel 32, a timer 46 that counts the time, and a drive buffer 47 that outputs dot on-off signals to the ink ejection heads 61 through 66. These elements and circuits are mutually connected via a bus 48. The control circuit 40 further includes an oscillator 51 that outputs the driving waveforms shown in FIG. 5, and a distributor 55 that distributes the outputs from the oscillator 51 to the ink ejection heads 61 through 66 at selected timings.

The control circuit 40 receives the image data processed by the computer PC, temporarily stores the image data in the RAM 43, and outputs the image data to the drive buffer 47 at a preset timing. The driver buffer 47 determines the on-off conditions of the respective driving waveforms W1, W2, and W3 in the respective pixels according to the image data and outputs the results of the determination to the distributor 55. The distributor 55 outputs the driving waveforms W1, W2, and W3 to the respective nozzles based on the input results, in order to create the variable size dots shown in FIG. 5. The relationship between the tone value of the image data and the on-off conditions of the three driving waveforms W1, W2, and W3 is stored in the form of the formation pattern table 96 in the ROM 42.

In the printer PRT of the embodiment having the hardware structure discussed above, while the sheet feed motor 23 feeds the sheet of printing paper P (hereinafter referred to as the sub-scan), the carriage motor 24 drives and reciprocates the carriage 31 (hereinafter referred to as the main scan), simultaneously with actuation of the piezoelectric elements PE on the respective ink ejection heads 61 through 66 of the print head 28. The printer PRT accordingly sprays the respective color inks to create dots and thereby forms a multi-color image on the printing paper P.

In this embodiment, the printer PRT has the print head that uses the piezoelectric elements PE to eject ink as discussed previously. The printer may, however, adopt another technique for ejecting ink. One alternative structure of the printer supplies electricity to a heater disposed in an ink conduit and utilizes the bubbles generated in the ink conduit to eject ink. The principle of the present invention is applicable to a variety of printers including thermal transfer printers, sublimation printers, and dot impact printers.

(2) Dot Formation Procedure

Figure 7:
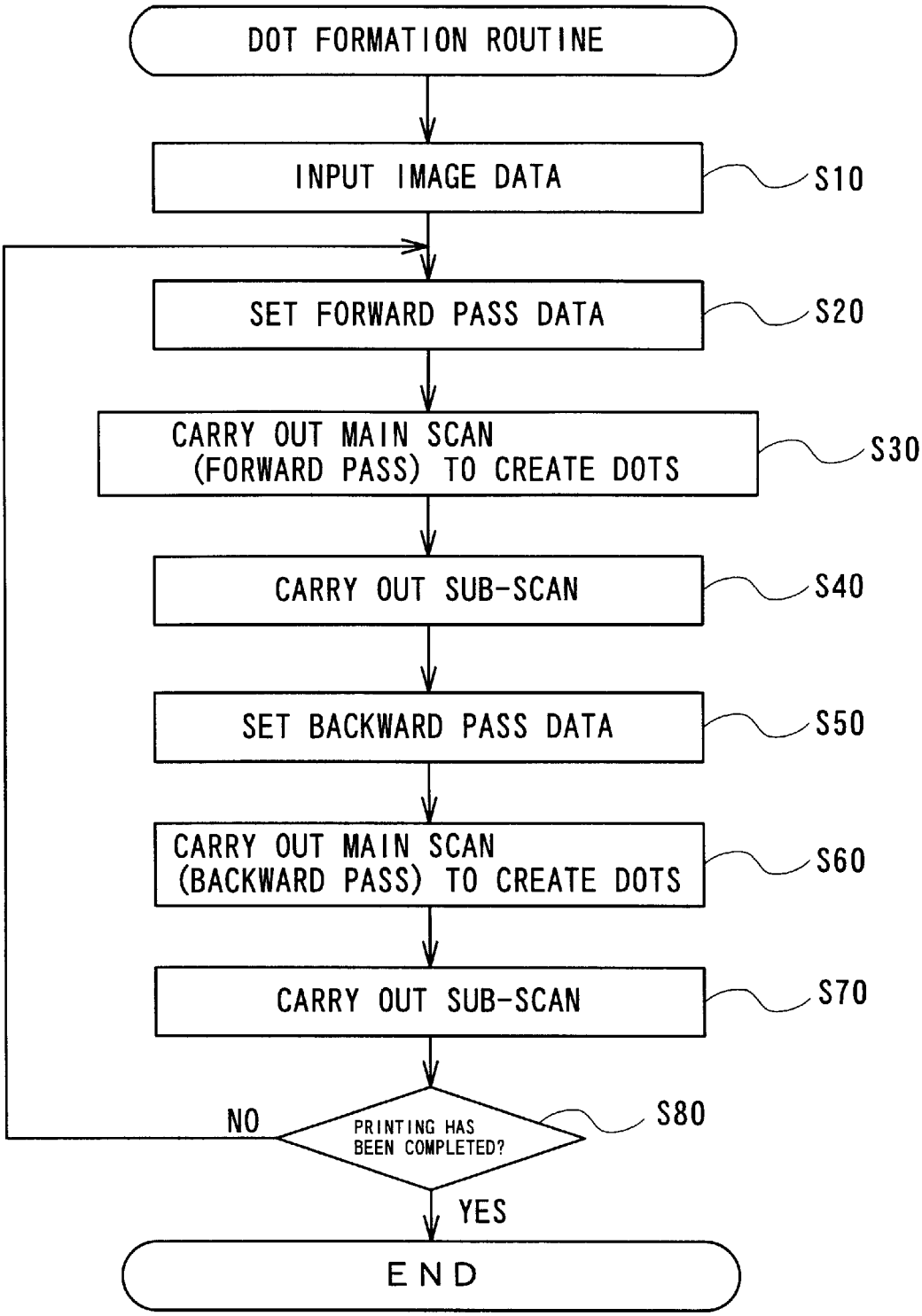
FIG. 7 is a flowchart showing a dot formation routine executed in the embodiment.

The following describes a dot formation procedure executed in this embodiment, with referring to the flowchart of FIG. 7. The dot formation routine of FIG. 7 is executed by the CPU 41 of the printer PRT. The printer PRT forms dots both in a forward pass and a backward pass of the main scan. This recording method is hereinafter referred to as the bi-directional recording.

When the program enters the dot formation routine of FIG. 7, the CPU 41 first inputs image data at step S10. The image data input here are those processed by the computer PC and represent densities TN to be expressed in respective pixels included in an image with inks used in the printer PRT. The density TN is expressed by four different levels, that is, values of 0 to 3.

The CPU 41 temporarily stores the input image data into the RAM 43. The CPU 41 sets data to be successively output to the respective nozzles in a forward pass of the main scan as forward pass data in the drive buffer 47 at step S20, and subsequently forms dots in the course of the forward pass of the main scan of the print head 28 at step S30. The CPU 41 then carries out the sub-scan, that is, feeds the printing paper P by a predetermined feeding amount at step S40. The CPU 41 similarly sets backward pass data in the drive buffer 47 at step S50, forms dots in the course of a backward pass of the main scan of the print head 28 at step S60, and carries out the sub-scan after formation of the dots at step S70. This series of the processing is repeated until it is determined at step S80 that the printing process has been concluded. This completes a printed image.

Figure 8A:
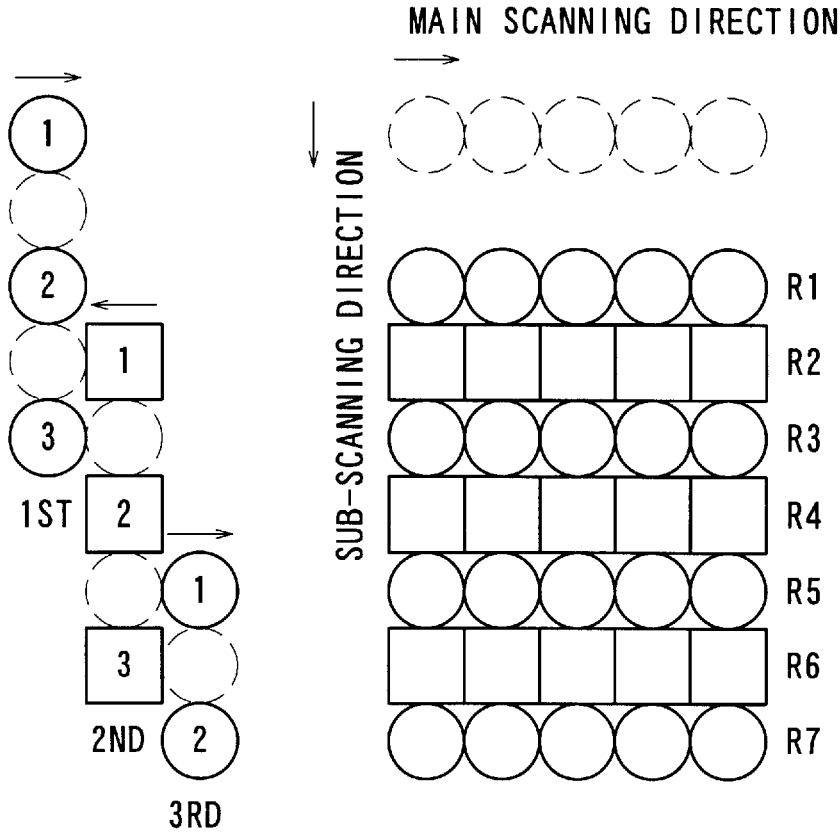
FIG. 8A and FIG. 8B show a process of creating dots in the embodiment.

FIG. 8A shows an exemplified process of dot formation in this embodiment. The left-side drawing of FIG. 8A shows the positions of the print head in the sub-scanning direction at first through third passes of the main scan. For convenience of illustration, the print head illustrated here has only three nozzles at a nozzle pitch of 2 dots. The encircled numerals represent numbers allocated to the nozzles. In this example, the first pass of the main scan forms dots with the second and the third nozzles while moving the print head forward (rightward in the drawing). The second pass of the main scan forms dots with all the first through the third nozzles while moving the print head backward (leftward in the drawing). The third pass of the main scan forms dots while moving the print head forward again. The right-side drawing of FIG. 8A shows the resulting dots thus created. Each open circle represents a dot formed in the forward pass of the main scan, and each open square represents a dot formed in the backward pass of the main scan. Symbols like R1 and R2 represent raster numbers allocated to respective raster lines, as a matter of convenience. The raster lines formed in the forward pass of the main scan and the raster lines formed in the backward pass of the main scan alternately adjoin to each other, so that an image is printed.

Figure 8B:
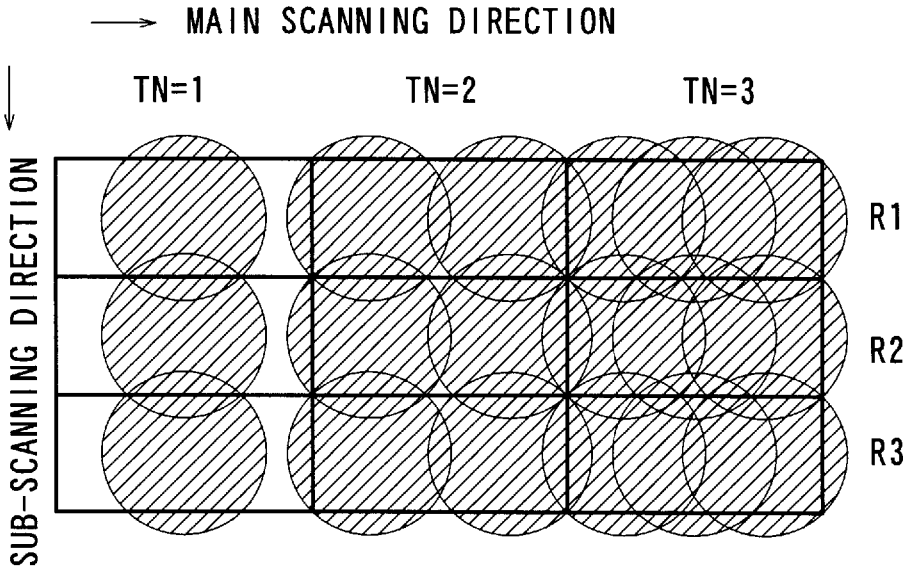

FIG. 8B shows a part of the image thus printed. Each rectangle represents a pixel, and each hatched circle represents a dot created in the pixel. The drawing of FIG. 8B shows three pixels in the main scanning direction included in the raster lines R1 through R3. In this example, the tone value TN of the image data sequentially varies from 1 to 3 in the main scanning direction. Dots corresponding to the respective tone values TN of the image data are formed according to the dot formation patterns shown in FIG. 5. The density corresponding to the tone value TN of the image data is expressed in each pixel by varying the number of dots created in the pixel.

As discussed above, in the printer PRT of this embodiment, the center of gravity of all the dots formed in each pixel is substantially coincident with the center of gravity of the pixel. This arrangement enables an image to be printed without causing any significant unevenness of density between adjoining pixels, thereby attaining the high quality printing.

Figure 9A:
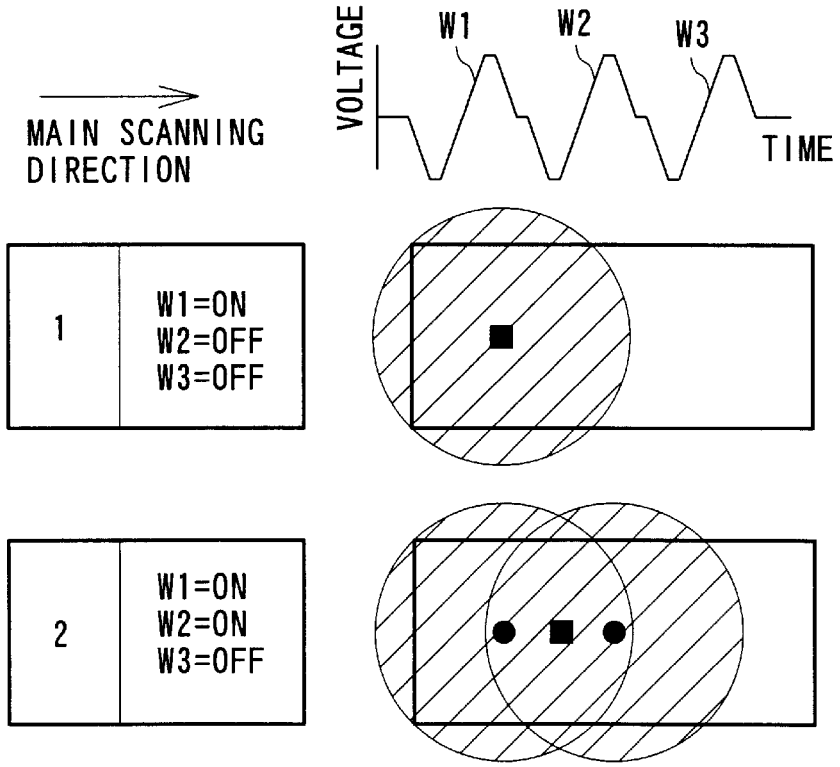
FIG. 9A and FIG. 9B show dot formation patterns as a comparative example.
Figure 9B:
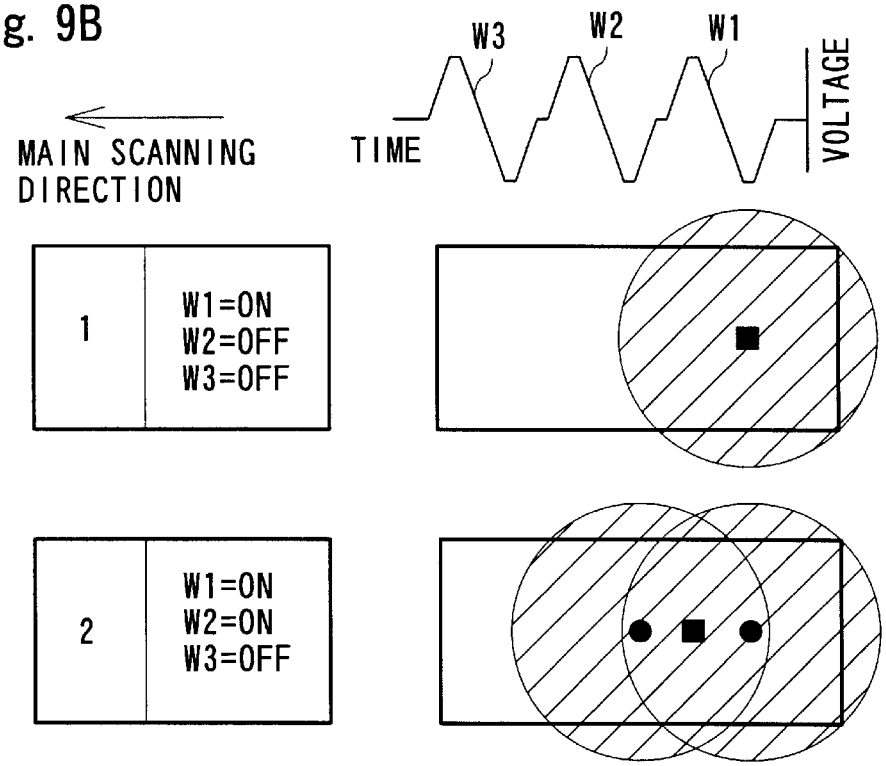

As a comparative example, FIG. 9A and FIG. 9B show dot formation patterns according to the tone values TN of the image data, where the position of the center of gravity of all the dots formed in a pixel is significantly deviated from the position of the center of gravity of the pixel. FIG. 9A and FIG. 9B show only the cases where the tone values TN of the image data are equal to 1 and 2. In these cases, the positions of the resulting dots are different from those shown in FIG. 5. Like the embodiment of the present invention shown in FIG. 5, at most three dots can be created in each pixel in this comparative example. In the comparative example, however, only the driving waveform W1 is set on to form one dot in a pixel. The driving waveforms W1 and W2 are set on to form two dots in a pixel. FIG. 9A shows the dots formed in the course of a forward pass of the main scan. Neither the position of the center of gravity of a dot formed in a pixel nor the position of the center of gravity of all the dots formed in a pixel, both of which are shown by the closed squares, is coincident with the position of the center of gravity of the pixel. FIG. 9B shows the dots formed in the course of a backward pass of the main scan. This setting changes the order of the driving waveforms in the forward pass of the main scan from the same in the backward pass of the main scan, so that the positions of the dots formed in the forward pass of the main scan are different from those formed in the backward pass of the main scan.

Figure 10:
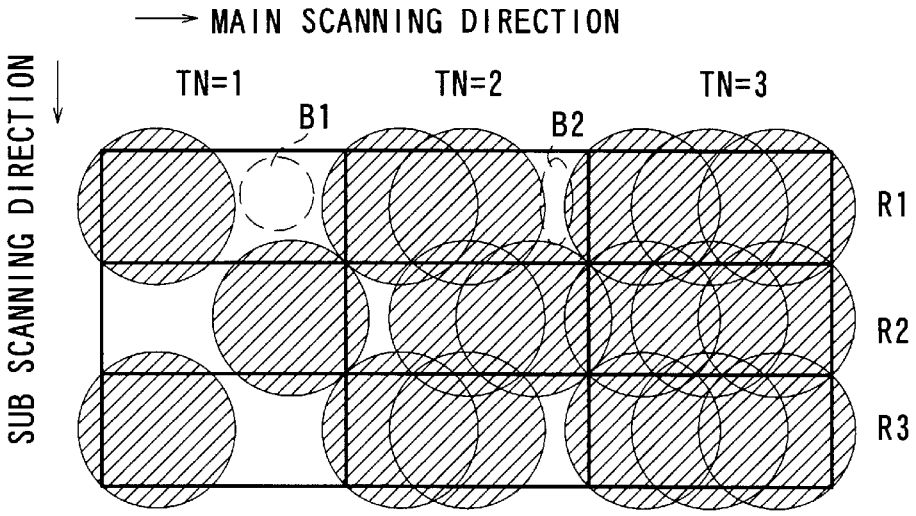
FIG. 10 shows dots formed in the comparative example.

FIG. 10 shows the dots formed according to the dot formation patterns of the comparative example shown in FIG. 9A and FIG. 9B. It is assumed that the feeding amounts shown in FIG. 8A are also adopted in the process of printing an image in the comparative example. Raster lines R1 and R3 are formed in the forward pass of the main scan, whereas a raster line R2 is formed in the backward pass of the main scan. The position of the center of gravity of all the dots formed in each pixel is deviated from the position of the center of gravity of the pixel. There is accordingly a misalignment in the main scanning direction of the positions of the dots formed in the course of the forward pass of the main scan with the positions of the dots formed in the course of the backward pass of the main scan. The resulting image printed according to the dot formation patterns of the comparative example shown in FIG. 9A and FIG. 9B has the unevenness of density and the roughness due to the misalignment of the positions of the dot formation. The resulting image accordingly has poor picture quality. The printer PRT of the embodiment, on the other hand, does not have any significant misalignment of the positions of the dot formation in the main scanning direction in the process of bi-directional recording as shown in FIG. 8B. This ensures the high picture quality of the resulting printed image.

The improvement in picture quality by making the center of gravity of all the dots formed in each pixel substantially coincident with the center of gravity of the pixel is not attained only in the case of the bi-directional recording. As shown in FIG. 10, when the position of the center of gravity of the dots formed in each pixel is deviated from the position of the center of gravity of the pixel, the unevenness of density is often observed between adjoining pixels in the main scanning direction. For example, blanks B1 and B2 shown in FIG. 10 cause the unevenness of density even in the case of forming dots only in the forward pass of the main scan. The printer PRT of the embodiment makes the position of the center of gravity of all the dots formed in each pixel substantially coincident with the position of the center of gravity of the pixel. This arrangement effectively prevents the unevenness of density and the roughness and thereby improves the picture quality of the resulting printed image.

Figure 11:
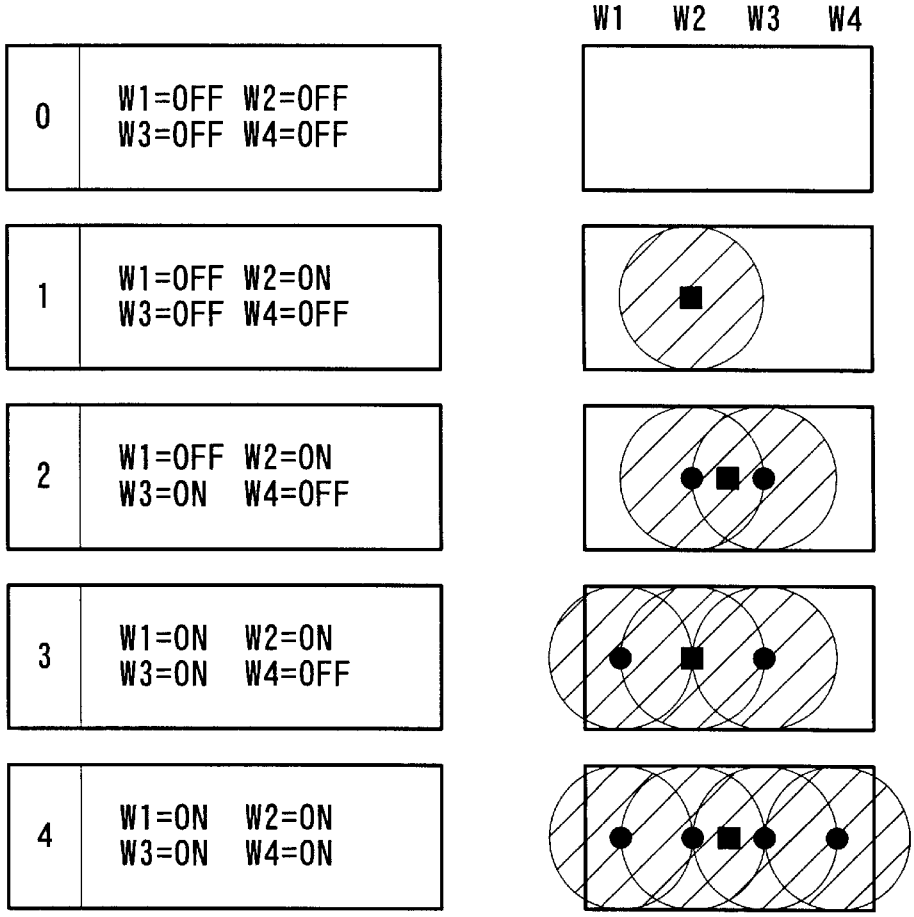
FIG. 11 shows dot formation patterns as a first modified example.

The above embodiment regards the case of forming at most three dots in each pixel. A variety of other settings may be applied for the maximum number of dots formed in each pixel. Dot formation patterns in the case of setting an even number, for example, four, to the maximum number of dots created in each pixel are shown as a first modified example in FIG. 11. The relationship between the tone value TN of the image data and the on-off conditions of driving waveforms W1 through W4 is specified as follows:

TN=0→W1=OFF, W2=OFF, W3=OFF, W4=OFF

TN=1→W1=OFF, W2=ON, W3=OFF, W4=OFF

TN=2→W1=OFF, W2=ON, W3=ON, W4=OFF

TN=3→W1=ON, W2=ON, W3=ON, W4=OFF

TN=4→W1=ON, W2=ON, W3=ON, W4=ON

In the case of the above settings of the dot formation patterns, when the tone values TN of the image data are equal to 0, 2, and 4, the center of gravity of all the dots created in one pixel is made substantially coincident with the center of gravity of the pixel. When the tone values TN of the image data are equal to 1 and 3, on the other hand, the center of gravity of all the dots created in one pixel is not made completely coincident with the center of gravity of the pixel. The above settings, however, minimize the deviation of the center of gravity of the dots formed in a pixel from the center of gravity of the gravity of the pixel. The dot formation patterns shown in FIG. 11 accordingly enable an image to be printed with little unevenness of density and roughness, thereby attaining the high quality printing. A variety of other settings may be applied for the dot formation patterns according to the maximum number of dots created in each pixel.

It is not necessary that the number of driving waveforms provided for each pixel coincides with the maximum number of dots created in the pixel. FIG. 12 shows dot formation patterns in the case of using five driving waveforms as a second modified example. In the example of FIG. 12, the dot formation patterns are set to enable the tone value TN of the image data to be expressed by six levels of 0 to 5 with the five driving waveforms. In another application, however, the tone value TN of the image data may be expressed by five levels of 0 to 4 according to the dot formation patterns excluding the case of setting all the driving waveforms on. This arrangement enables the center of gravity of all the dots created in each pixel to be substantially coincident with the center of gravity of the pixel even in the case where the tone value of the image data to be expressed in each pixel is at the level defined by an odd number, that is, in the case where an even number of dots are formed in each pixel, by some reasons of the image processing executed by the computer PC. This ensures a further improvement in picture quality.

Figure 13:
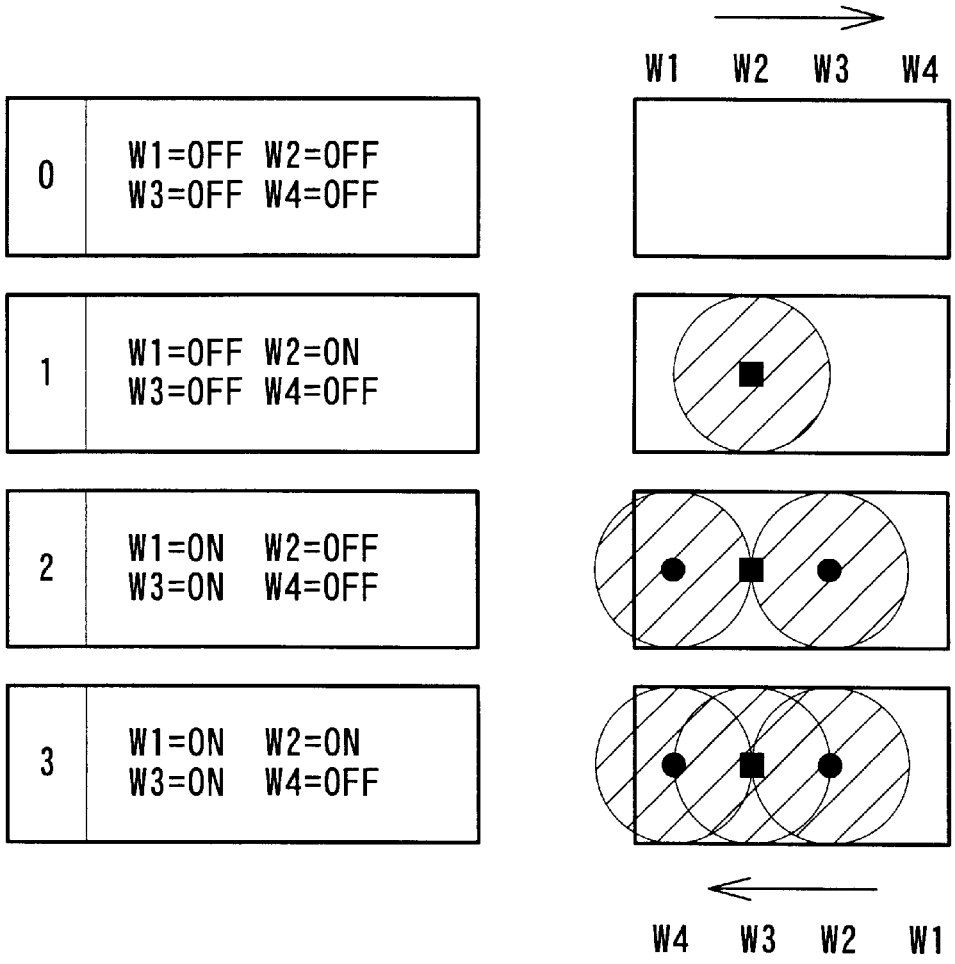
FIG. 13 shows dot formation patterns as a third modified example.

Even in the case where the center of gravity of all the dots formed in each pixel is not coincident with the center of gravity of the pixel, a greater number of driving waveforms than the maximum number of dots created in each pixel may be used to set the dot formation patterns. FIG. 13 shows dot formation patterns in the case of using three driving waveforms selected among four driving waveforms provided for each pixel, as a third modified example. As shown in the top of FIG. 13, the driving waveforms W1, W2, W3, and W4 are sequentially output in the forward pass of the main scan with the movement of the carriage 31 in the direction of the arrow. As shown in the bottom of FIG. 13, on the other hand, the driving waveforms W1, W2, W3, and W4 are sequentially output in the backward pass of the main scan with the movement of the carriage 31 in the direction of the arrow. In the example of FIG. 13, in the forward pass of the main scan, when the tone value TN of the image data is equal to 1, only the driving waveform W2 is set on. When the tone value TN of the image data is equal to 2, the driving waveforms W1 and W3 are set on. When the tone value TN of the image data is equal to 3, the driving waveforms W1, W2, and W3 are set on. Namely the driving waveform W4 is not used in the forward pass of the main scan. In the backward pass of the main scan, on the other hand, the driving waveforms W2 through W4 are used.

This arrangement enables the position in the main scanning direction of the center of gravity of the dots formed in each pixel in the forward pass of the main scan to be substantially coincident with the position in the main scanning direction of the center of gravity of the dots formed in each pixel in the backward pass of the main scan. There is a driving waveform that is not involved in the dot creation in each pass of the main scan. This enables the fine adjustment of the position of the center of gravity of all the dots formed in each pixel. For example, when there is a tendency of advancing the ink ejection timing in the forward pass of the main scan, the selective use of the driving waveforms W2 through W4 in the forward pass of the main scan enables dots to be formed at appropriate positions. The arrangement of providing a greater number of driving waveforms than the maximum number of dots created in each pixel advantageously allows the more flexible selection of the dot formation patterns.

Figure 14:
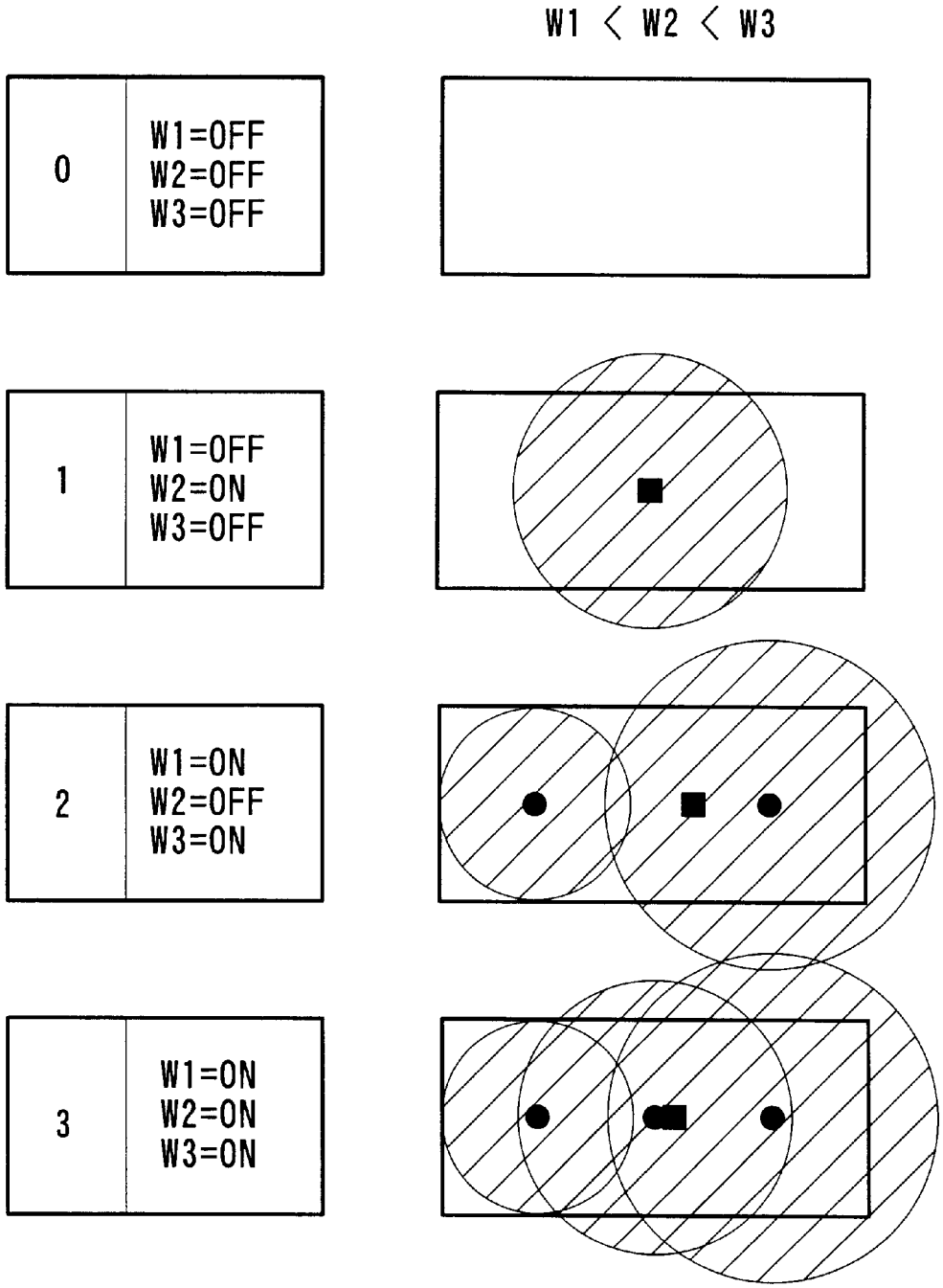
FIG. 14 shows dot formation patterns as a fourth modified example.

The embodiment discussed above regards the case of using the identical driving waveforms to eject a fixed quantity of ink. The principle of the present invention may, however, be applicable to the case where a plurality of different driving waveforms are provided for each pixel to eject different quantities of ink. FIG. 14 shows dot formation patterns in such a case as a fourth modified example. In the example of FIG. 14, the quantity of ink ejection increases in the sequence of the driving waveforms W1, W2, and W3. In this case, the dot formation patterns are set to minimize the deviation of the center of gravity of the dots formed in each pixel from the center of gravity of the pixel as shown in FIG. 14. Application of these dot formation patterns ensures the high quality printing with less unevenness of density and roughness.

Figure 15:
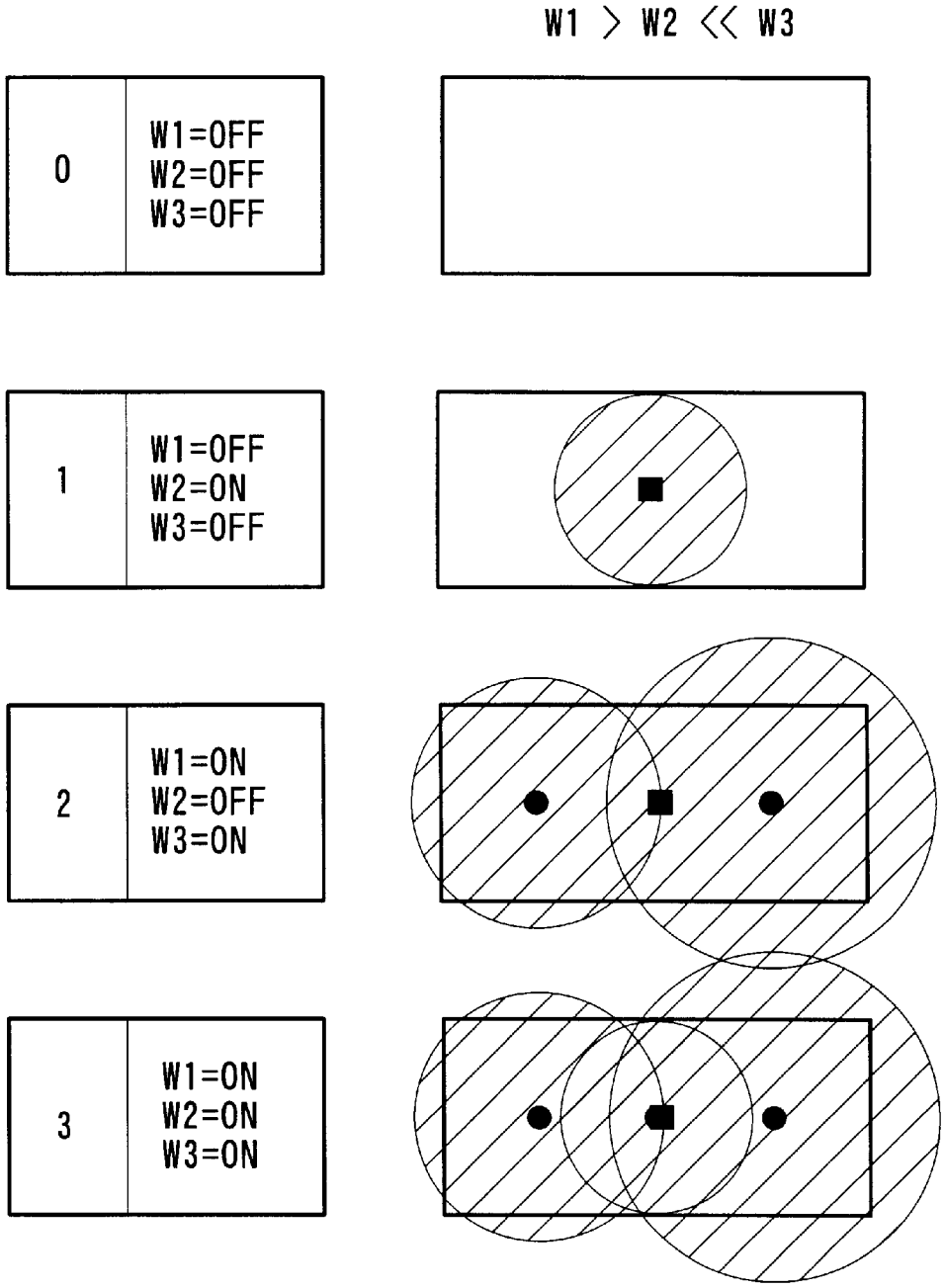
FIG. 15 shows dot formation patterns as a fifth modified example.

A variety of settings are applicable to the relationship between the driving waveform and the quantity of ink ejection in the case where a plurality of different driving waveforms are used to eject different quantities of ink. For example, as shown in a fifth modified example of FIG. 15, the quantity of ink ejection may increase in the sequence of the driving waveforms W2, W1, and W3. In this case, the relationship between the driving waveform and the quantity of ink ejection is set to make the dot having the minimum quantity of ink formed closer to the center of gravity of the pixel. When the dot having the minimum quantity of ink, that is, the small dot, is used for printing in a low tone area, this arrangement enables the small dot to be formed in the vicinity of the center of gravity of each pixel included in the low tone area. The small dot occupies a small area, so that a deviation of the position of the small dot from the position of the center of gravity of the pixel is readily observed as a positional misalignment of dots. Formation of the dot having the minimum quantity of ink in the vicinity of the center of gravity of each pixel as shown in FIG. 15 ensures the high quality printing with little unevenness of density and roughness due to the positional misalignment of dots. This effect is especially significant in the low tone area where the small dot is used for printing.

In the process of creating dots in the bi-directional recording according to the dot formation patterns shown in FIG. 15, when the tone value TN of the image data is equal to 1, the position of the small dot formed in a pixel is substantially coincident with the position of the center of gravity of the pixel in both the forward pass and the backward pass of the main scan. If a dot formation pattern different from that shown in FIG. 15 is applied to form the small dot with either the driving waveform W1 or the driving waveform W3, since the sequence of the driving waveforms in the forward pass of the main scan is different from the sequence in the backward pass of the main scan (see FIG. 9A and FIG. 9B), the position of forming the small dot in the forward pass of the main scan is significantly different from that in the backward pass of the main scan. The positional misalignment of the small dot is readily observed and thus significantly damages the picture quality of the resulting printed image. The dot formation patterns shown in FIG. 15 to enable the dot having the minimum quantity of ink to be formed in the vicinity of the center of gravity of each pixel are thus specifically effective in the case of the bi-directional recording.

Figure 16A:
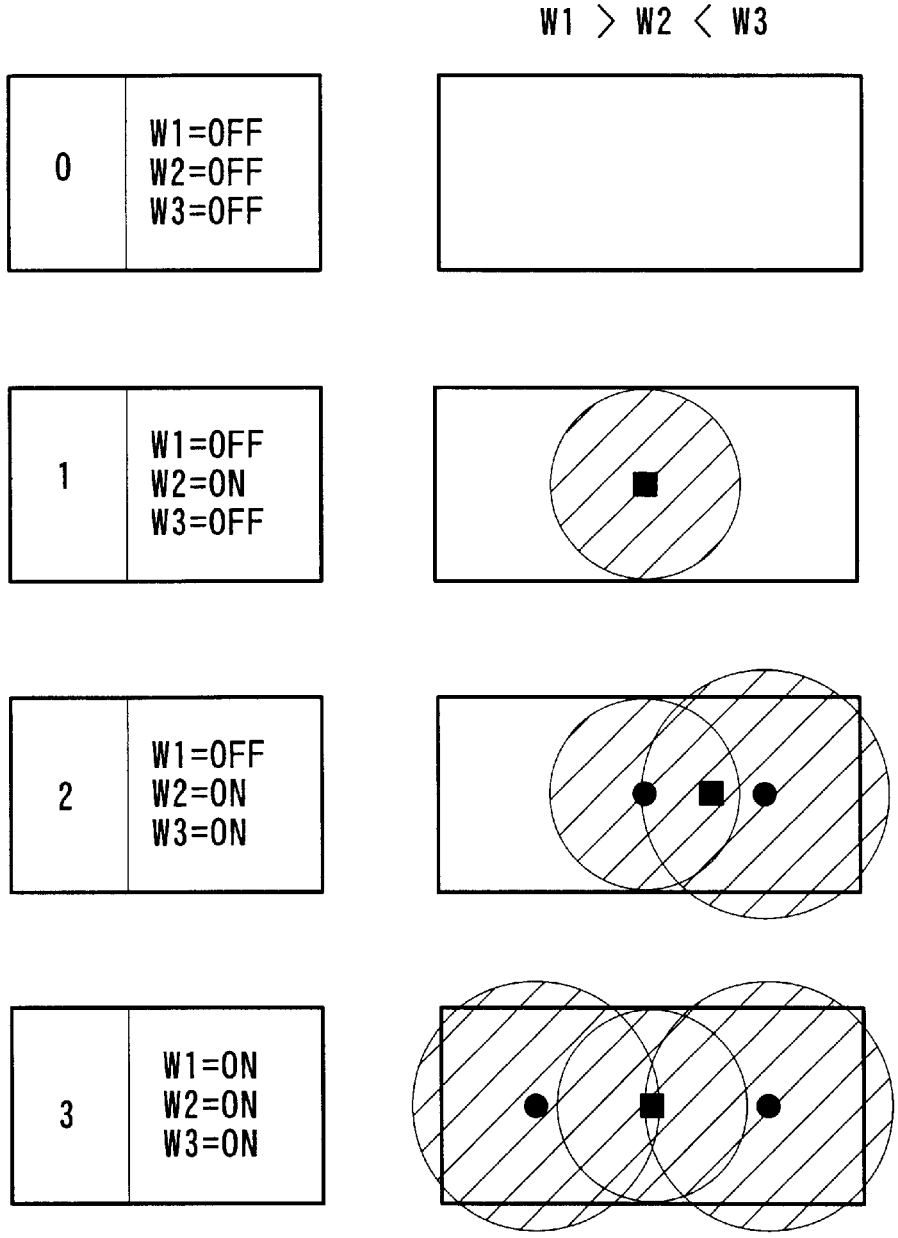
FIG. 16A and FIG. 16B show dot formation patterns as a sixth modified example.
Figure 16B:
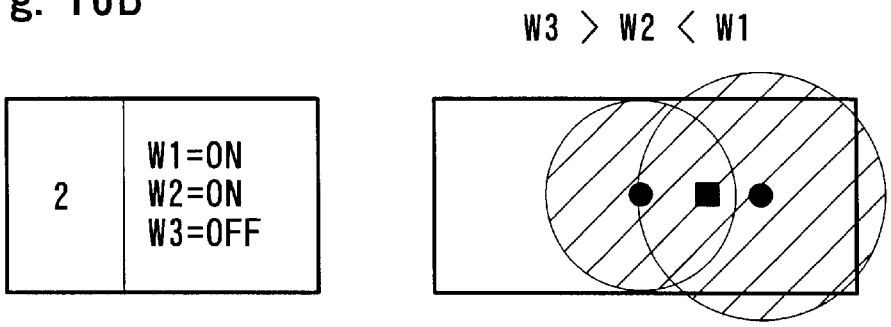

It is not necessary that all the plurality of driving waveforms used to eject different quantities of ink are different from one another. Dot formation patterns with such driving waveforms are shown as a sixth modified example in FIG. 16A and FIG. 16B. In the example of FIG. 16A and FIG. 16B, driving waveforms W1, W2, and W3 are provided to enable two variable size dots having different quantities of ink, that is, a large dot and a small dot, to be created in the respective pixels. The driving waveform W2 is used to form the small dot, whereas the driving waveforms W1 and W3 are used to form the large dot. One small dot is created at the position that is substantially coincident with the center of gravity of a pixel in response to the driving waveform W2. Two large dots are created, on the other hand, at symmetrical positions with respect to the center of gravity of a pixel in response to the driving waveforms W1 and W3. A predetermined density, that is, the tone value TN of the image data equal to 2, is expressed by a combination of one large dot with one small dot. In this case, as shown in FIG. 16A, the driving waveforms W2 and W3 are set on to form one large dot and one small dot. The center of gravity of the two dots created in a pixel is deviated from the center of gravity of the pixel.

It is here assumed that the bi-directional recording is carried out according to the dot formation patterns shown in FIG. 16A and FIG. 16B. In the case of bi-directional recording, the sequence of the driving waveforms output in the backward pass of the main scan is reverse to the sequence of the driving waveforms output in the forward pass of the main scan (see FIG. 9A and FIG. 9B). FIG. 16B shows the driving waveforms output in the backward pass of the main scan in the case of the tone value TN of the image data equal to 2. In the backward pass of the main scan, the driving waveforms W1, W2, and W3 are output in this sequence from the right side of the pixel. Since the driving waveforms W1 and W3 are identical with each other in the example of FIG. 16A and FIG. 16B, the driving waveforms W1 and W2 are set on in the backward pass of the main scan to create one small dot and one large dot in a pixel, which have the center of gravity at the same position as that of the small dot and the large dot formed in the forward pass of the main scan.

Even when the selected dot formation pattern makes the center of gravity of dots formed in one pixel deviated from the center of gravity of the pixel, the driving waveforms of this example, which can symmetrically form the respective size dots in one pixel, enable the position of the center of gravity of dots formed in the forward pass of the main scan to be substantially coincident with the position of the center of gravity of dots formed in the backward pass of the main scan. Namely this arrangement of the example makes the center of gravity of dots formed in the forward pass of the main scan substantially coincident with the center of gravity of dots formed in the backward pass of the main scan in the bi-directional recording, thereby improving the picture quality of the resulting printed image. The sixth modified example regards the case of creating two variable size dots having different quantities of ink. The same effects can, however, be attained in the case of creating a greater number of variable size dots according to dot formation patterns equivalent to those of FIG. 16A and FIG. 16B.

Figure 17:
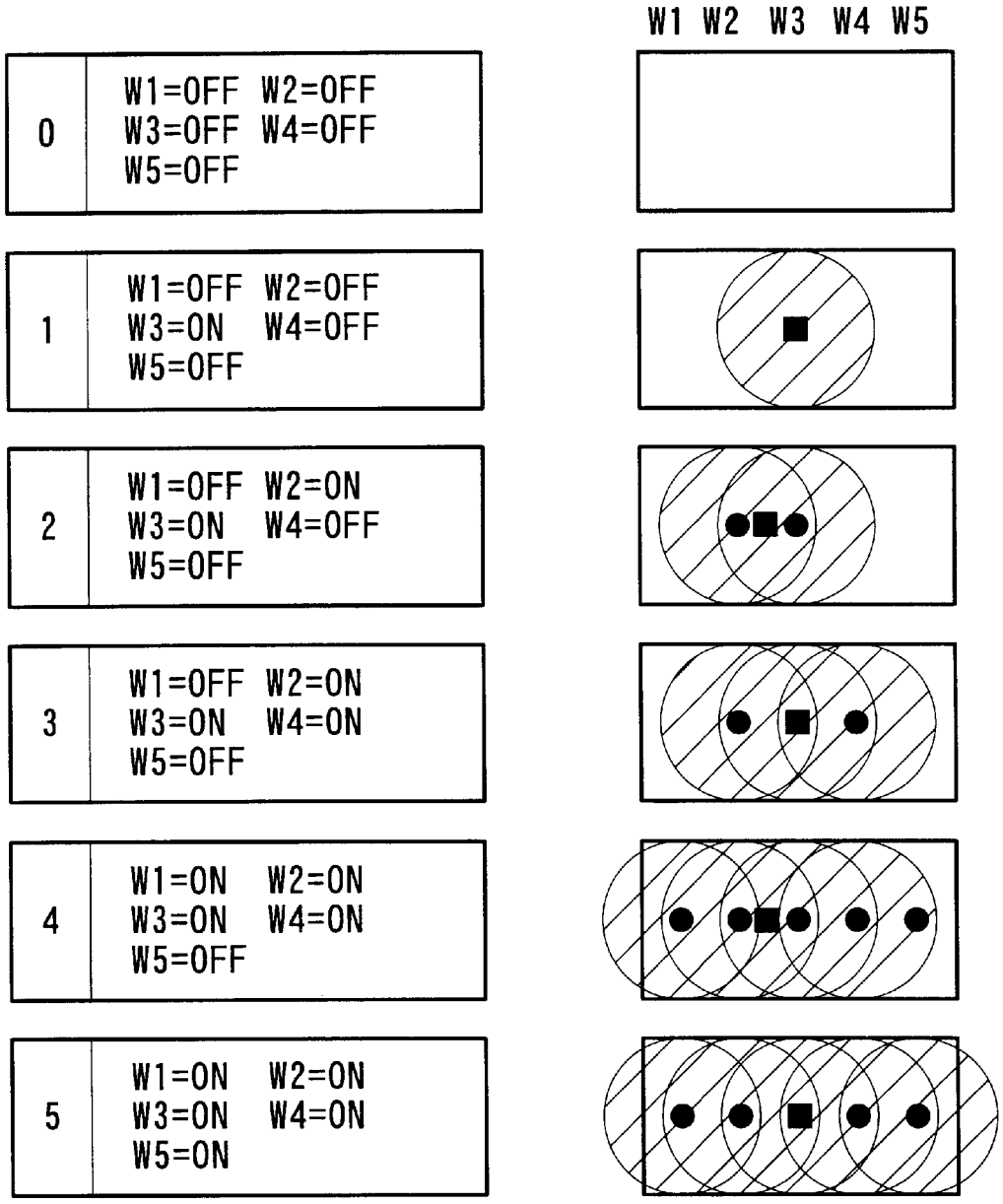
FIG. 17 shows dot formation patterns as a seventh modified example.

In the embodiment and its modified examples discussed above, the dot formation patterns are set to minimize the deviation of the position of the center of gravity of dots formed in one pixel from the position of the center of gravity of the pixel. The settings of the dot formation patterns are, however, not restricted to those for minimizing the deviation. One example of such settings of the dot formation patterns is shown as a seventh modified example in FIG. 17. Like the second modified example shown in FIG. 12, five driving waveforms are provided for each pixel in the seventh modified example of FIG. 17. The difference from the example of FIG. 12 is the settings of the dot formation patterns to create even numbers of dots, that is, the dot formation patterns corresponding to the tone value TN of the image data equal to 2 and 4. In the example of FIG. 12, the dot formation patterns are set to turn the driving waveform W3 off, in order to make dots created at symmetrical positions in each pixel. This arrangement causes the center of gravity of the dots formed in a pixel to be substantially coincident with the center of gravity of the pixel. In the example of FIG. 17, on the other hand, the dot formation patterns are set to turn the driving waveform W3 on, in order to narrow the distance between adjoining dots. This arrangement, which creates dots in a closed manner, enables formation of a well-shaped resulting large dot that is relatively similar to an ellipse. Although these settings do not minimize the deviation of the center of gravity of dots formed in one pixel from the center of gravity of the pixel, but the deviation is in an allowable range from the viewpoint of the desired picture quality. As described above with the embodiment of the present invention and its modified examples, a variety of dot formation patterns may be set by taking into account the deviation of the center of gravity of dots formed in a pixel from the center of gravity of the pixel.

As discussed above, a variety of dot formation patterns are applicable to create dots. In the actual printer, there are generally some variations in dot forming position and in quantity of ink ejection due to the difference in ink ejection properties among the respective nozzles. The dot formation patterns described in this specification represent the settings in the case of dot formation in the optimum conditions. A certain deviation of the center of gravity of the dots formed in each pixel from the center of gravity of the pixel due to such variations is naturally allowed in the actual process of dot formation.

The present invention is not restricted to the above embodiment or its modifications, but there may be many other modifications, changes, and alterations without departing from the scope or spirit of the main characteristics of the present invention. For example, the variety of control procedures discussed in the above embodiment may partly or totally be actualized by the hardware configuration, instead of the software programs.

The scope and spirit of the present invention are limited only by the terms of the appended claims.

What is claimed is:

1. A printing apparatus that forms dots and respective pixels with a print head in response to a driving signal, while scanning said print head relative to one axis of a printing medium forward and backward, thereby printing a resulting image on said printing medium, said printing apparatus comprising:

a drive unit that outputs the driving signal to said print head in the course of forward and backward passes of the scan of said print head and enables at most N dots to be created in each pixel in each pass of the scan, where N is an integer of not less than 2, according to a predetermined dot formation pattern, which has been set by taking into account a deviation in a direction of movement of said head of a center of all said dots in combination to be created in each pixel from a center of a pixel.

2. A printing apparatus in accordance with claim 1, wherein the predetermined dot formation pattern minimizes the deviation of the center of all the dots to be created in each pixel from the center of the pixel.

3. A printing apparatus in accordance with claim 1, wherein said drive unit forms dots according to the predetermined dot formation pattern, which has been set by selecting a certain frequency of timings corresponding to a number of dots to be created in each pixel among a frequency of timings M provided with regard to each pixel, where M is an integer of not less than N.

4. A printing apparatus in accordance with claim 3, wherein the driving signal is used to create a fixed size dot, M is an odd number of not less than 3, and the predetermined dot formation pattern causes dots to be formed at symmetrical positions in each pixel along the axis of the forward and backward passes of the scan.

5. A printing apparatus in accordance with claim 1, wherein said drive unit creates dots in two directions, that is, in both the forward pass and the backward pass of the scan of said print head relative to said printing medium.

6. A printing apparatus in accordance with claim 1, wherein said drive unit creates dots according to the predetermined dot formation pattern, which has been set by selecting a certain frequency of timings corresponding to a number of dots to be created in each pixel among a frequency of timings M provided with regard to each pixel, where M is an integer of not less than N, the driving signal is used to create at least two variable size dots, and the predetermined dot formation pattern causes a minimum size dot to be formed closer to the center of each pixel.

7. A printing apparatus in accordance with claim 6, wherein said drive unit creates dots in two directions, that is, in both the forward pass and the backward pass of the scan of said print head relative to said printing medium, the driving signal enables each variable size dot to be formed in a symmetrical manner with respect to the center of each pixel, and the predetermined dot formation pattern creates dots in such a manner that each variable size dot to be created in each pixel has the center that is located on a certain side, which has been preset for each variable size dot, relative to the center of the pixel, whether the variable size dot is created in the course of the forward pass of the scan or in the course of the backward pass of the scan.

8. A printing apparatus in accordance with claim 1, wherein said print head creates dots by ejecting ink.

9. A method of forming dots in respective pixels with a print head in response to a driving signal, while scanning said print head relative to one axis of a printing medium forward and backward, thereby printing a resulting image on said printing medium, said method comprising the step of:

outputting the driving signal to said print head in the course of forward and backward passes of the scan of said print head and enabling at most N dots to be created in each pixel in each pass of the scan, where N is an integer of not less than 2, according to a predetermined dot formation pattern, which has been set by taking into account a deviation in a direction of movement of said head of a center of all said dots in combination to be created in each pixel from a center of a pixel.

10. A recording medium, in which a specific program for driving printing apparatus is recorded in a computer readable manner, said printing apparatus enabling at most N dots to be created in each pixel with a print head in response to a driving signal, where N is an integer of not less than 2, according to a predetermined dot formation pattern, while scanning said print head relative to one axis of a printing medium forward and backward, said specific program comprising timing data that specify the predetermined dot formation pattern, which has been set by taking into account a deviation in a direction of movement of said head of a center of all said dots in combination to be created in each pixel from a center of a pixel.

* * * * *